United States Patent [19]

Russ

[11] 4,276,542

[45] Jun. 30, 1981

[54] ALARM SYSTEM FOR DWELLINGS

[76] Inventor: Raymond Russ, 44 Joyce Dr., Fairborn, Ohio 45324

[21] Appl. No.: 972,465

[22] Filed: Dec. 22, 1978

[51] Int. Cl.[3] ..... G08B 7/00

[52] U.S. Cl. ..... 340/326; 340/329; 340/331; 340/371

[58] Field of Search ..... 340/326, 327, 331, 332, 340/75, 88, 371, 286, 328, 329, 393

[56] References Cited

U.S. PATENT DOCUMENTS

| | | | |
|---|---|---|---|
| 2,082,789 | 6/1937 | Chase | 340/331 |
| 3,599,201 | 8/1971 | Clardy et al. | 340/326 |
| 3,624,635 | 11/1971 | Less | 340/326 |
| 3,810,149 | 5/1974 | Miller | 340/326 |
| 3,863,236 | 1/1975 | Clardy | 340/326 |
| 3,911,425 | 10/1975 | Muncheryan | 340/326 |
| 3,991,415 | 11/1976 | Baar | 340/326 |
| 3,999,176 | 12/1976 | Kellogg et al. | 340/331 |
| 4,003,040 | 1/1977 | Browand | 340/332 |

*Primary Examiner*—James J. Groody
*Attorney, Agent, or Firm*—Biebel, French & Nauman

[57] ABSTRACT

An emergency signaling system using the existing two-wire circuit (10) between a switch assembly (15) located within a dwelling and an externally mounted lamp housing (20) includes a switch (25) having an "off" position (27), a "normally on" position (28) whereby a lamp (55) is illuminated continuously, and an "alert" position (29) which activates a circuit (35) preferably included within the same protective enclosure (30) which contains the switch. The circuit (35) causes the current to the exterior lamp to be interrupted at a periodic rate, and it may also include as optional features an audible alarm (40) and a visual indicator (45) to identify when the alert feature is in operation. An adapter (60) is positioned between the lamp (55) and the existing lamp socket (50), and the adapter includes a circuit (75) responsive to the interruption of the current in the two-wire circuit to activate an audible alarm (65). In one embodiment, a triac (CR1) is placed in series with the lamp (55) and the sensing circuit controls the operation of the triac and the audible alarm. In another embodiment of the invention, a pair of relays are used to activate the alarm whenever the current is interrupted at the periodic rate.

10 Claims, 4 Drawing Figures

ALARM SYSTEM FOR DWELLINGS

BACKGROUND OF THE INVENTION

This invention relates to an alarm system which may be activated by a switch located within a dwelling to provide on the outside of the dwelling both audio and visual indications of an emergency condition.

Emergency indicating devices using externally mounted lamps and audio alarm devices, particularly for dwellings, are shown in U.S. Pat. Nos. 3,599,201; 3,624,635; 3,863,236; 3,911,425; and 4,003,040.

In some of these prior art devices, the existing externally mounted lamp housing is employed to house the audible alarm device and usually a second, emergency indicating lamp. Some of the devices shown in the above patents require that the circuit between the interior of the dwelling and the externally mounted lamp housing include at least three wires to accommodate the alarm feature requiring a modification of the existing wiring, and other patents require that a special lamp housing be installed on the exterior of the dwelling.

In all of these devices, the occupant will actuate a switch which causes an indication of an emergency condition be on the outside of the dwelling by the flashing of a lamp and/or the sounding of an audible alarm.

Such devices are useful to alert passersby that an emergency condition exists within the dwelling. These devices are also useful to assist a policeman, fireman or ambulance driver in locating the home or apartment requesting emergency assistance.

SUMMARY OF THE INVENTION

This invention relates to an emergency signaling system using the existing two-wire circuit between a switch located within a residence, and an already existing externally mounted lamp.

Within the dwelling, an existing on-off switch for the existing external lamp is replaced with a three-position switch having a center "off" position, a "normally on" position and an "alert" position. Associated with this switch, and preferably within the same protective enclosure, is a first circuit for interrupting the current to the externally mounted lamp at a periodic rate when the switch is in the "alert" position. An audio indicator may be optionally included within the enclosure, and also a light emitting diode so that the occupants of the dwelling may know when the switch is placed in the "alert" position.

On the exterior of the dwelling, an adapter is placed between an existing lamp socket and the lamp. The adapter includes an audible alarm and a second circuit which is responsive to the interruption of the current caused by the flasher to activate the alarm so that the alarm and the lamp will be activated at the periodic rate.

Two embodiments of the invention are disclosed. In the first and preferred embodiment, the first circuit means associated with the switch within the dwelling includes a flasher circuit which interrupts the current to the lamp at a periodic rate. In parallel with the flasher are series resistors to provide current at a reduced rate to the external circuit, and across one of these resistors is placed a circuit including the audible alarm and the light emitting diode which allows the occupants of the residence to know when the alert feature is in operation.

Within the adapter assembly on the exterior of the dwelling, a second circuit includes a triac connected in series with the lamp. A bilateral trigger diode is connected to the gate electrode of the triac, and the diode has its threshold set to gate the triac into conduction only when full current is applied to the lamp. When the flasher is operating, and reduced current is applied to the lamp circuit, the triac will not be gated on, and therefore the lamp will not be illuminated. Connected in parallel with the triac is an alarm circuit which includes the audible alarm which will then be activated during those periods when reduced current is applied to the lamp circuit. In this embodiment, the lamp and the audible alarm will operate alternately when the interior switch is placed in the "alert" position.

In the second embodiment of the invention, a flasher is placed in series with the "alert" position of the switch and the existing two-wire innerconnection with the exterior lamp. An optional audible alarm and light emitting diode may be connected in parallel with the flasher to indicate when the switch is placed in the alert position. The adapter assembly on the exterior of the dwelling includes a bridge rectifier, a pair of relays, a storage capacitor, a pair of blocking diodes, and the audible alarm. The first relay is activated whenever current is applied to the exterior circuit, and this relay includes a circuit which allows the storage capacitor periodically to receive a charge. The second relay is operated from the energy in the storage capacitor and will remain energized only so long as the current to the exterior circuit is interrupted no slower than the periodic rate. Therefore, the second relay will remain energized while the current is interrupted, and this relay includes contacts which provide a current path to the audible alarm which will then be activated as the current is reapplied to the external circuit at the periodic rate in synchronism with the flashing of the exterior lamp.

With both embodiments of the invention, only the interior switch need be replaced, and an adapter mounted between the lamp and the existing lamp socket on the exterior of the dwelling in order for the present invention to be installed and used. Of course, the switch and adapter could be installed initially in a new home or during remodeling.

Accordingly, it is an object of this invention to provide an emergency signaling system using an existing two-wire circuit between a switch located within a dwelling and an externally mounted lamp, said switch having an "off" position, a "normally on" position, and an "alert" position, and associated with said switch within said dwelling, first circuit means connectable in series with said two-wire circuit, said circuit means being responsive to said "alert" position of said switch for interrupting the current to said externally mounted lamp at a periodic rate, and associated with said lamp located on the exterior of the dwelling, said lamp being connected to said two-wire circuit, an audible alarm, and second circuit means, responsive to the interruption of the current in said two-wire circuit for activating said alarm, whereby said lamp will flash and said alarm will be sounded at said periodic rate when said switch is placed in the "alert" position, and whereby said lamp will light continuously and said alarm will be silent when said switch is placed in the "normally on" position.

Other objects and advantages of the invention will be apparent from the following description, the accompanying drawings and the appended claims.

DESCRIPTION OF THE PREFERRED EMBODIMENTS

Figure 1:
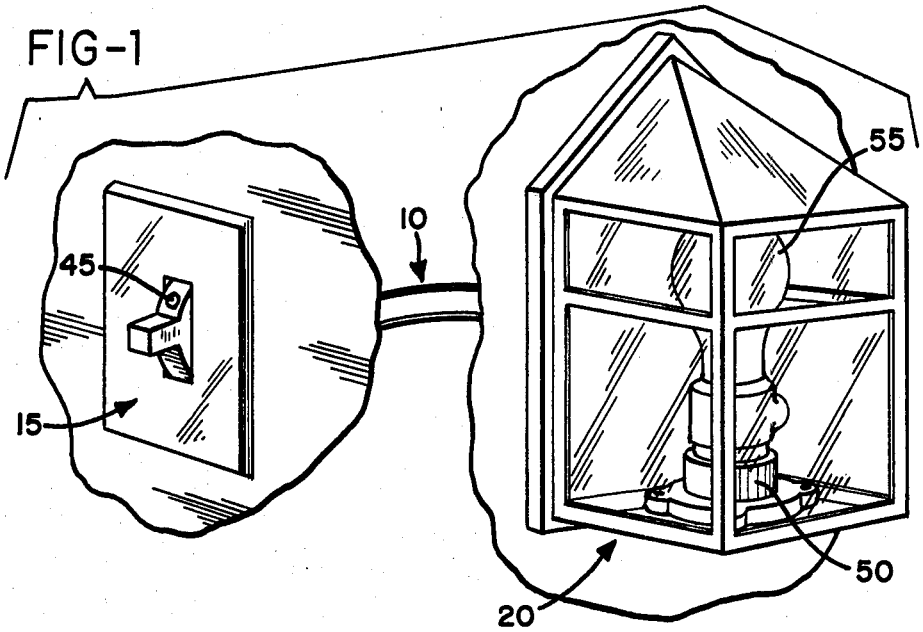
FIG. 1 is a diagrammatic perspective view showing an internally located switch assembly and an externally located lamp housing.
Figure 2:
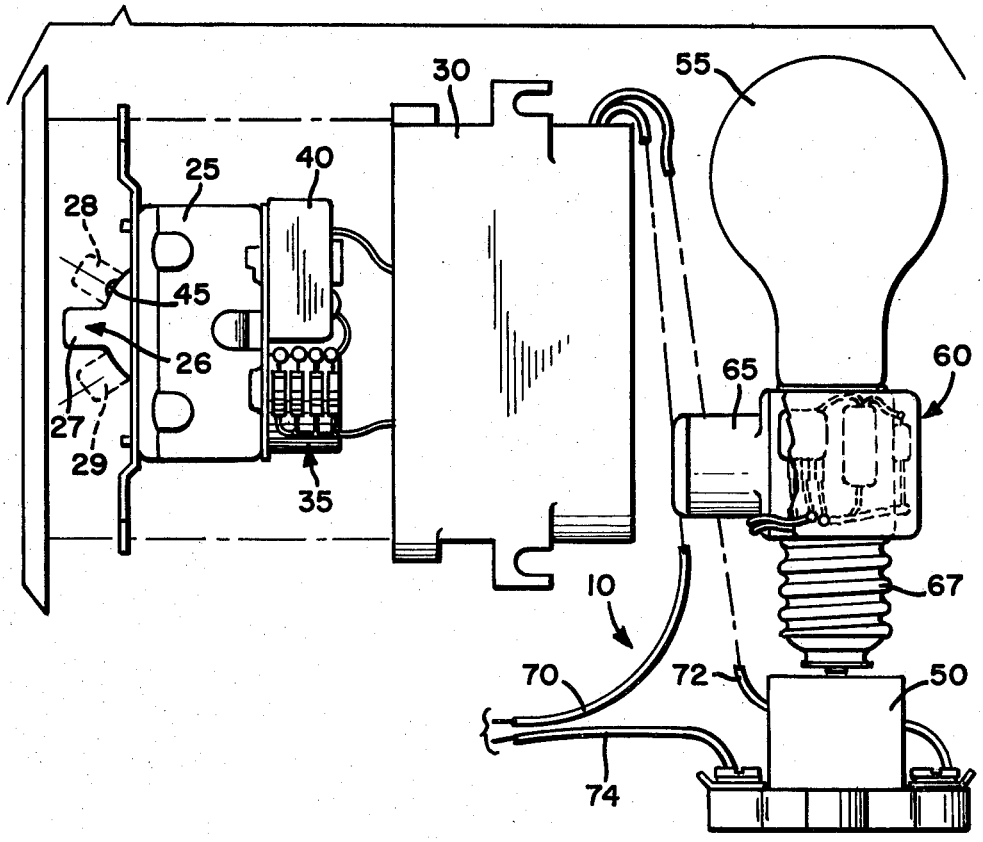
FIG. 2 is a diagrammatic elevational view showing details of the switch assembly and the lamp with adapter assembly.

Referring now to the drawings which show a preferred embodiment of the invention, and particularly FIGS. 1 and 2, the emergency signaling system constructed according to this invention uses an existing two wire circuit 10 between a switch assembly 15 located within a dwelling and an externally mounted lamp assembly 20.

Within the dwelling, the switch assembly 15 includes a three position electrical switch 25 including an actuator 26 having a center off position 27, and up "normally on" position 28, and a down "alert" position 29. The switch 25 is normally mounted within a protective enclosure 30.

The switch assembly 15 also includes circuit means 35, physically associated with the switch 25, which is actuated when the switch is in the "alert" position 29 to cause the externally mounted lamp to flash. Also included within the switch assembly 15 is an audible alarm 40 and visual indicator lamp or LED 45.

As shown in FIGS. 1 and 2, the lamp housing 20 includes a socket 50, a conventional incandescent lamp 55, and an adapter assembly 60 which includes the circuitry necessary to sense when the switch 25 is placed into the "alert" position to cause an audible alarm 65 to sound. The adapter 60 is provided with a conventional screw base 67 which is accepted into the lamp socket 50, and it in turn is provided with a receptacle which accepts the base of the incandescent bulb 55.

Thus, all that is necessary to install the present invention into an existing dwelling having a two wire circuit between an interiorly mounted switch and an externally mounted lamp is to replace the existing switch with the switch assembly 15 and to add the adapter 60 between the existing lamp socket and the lamp bulb.

Figure 3:
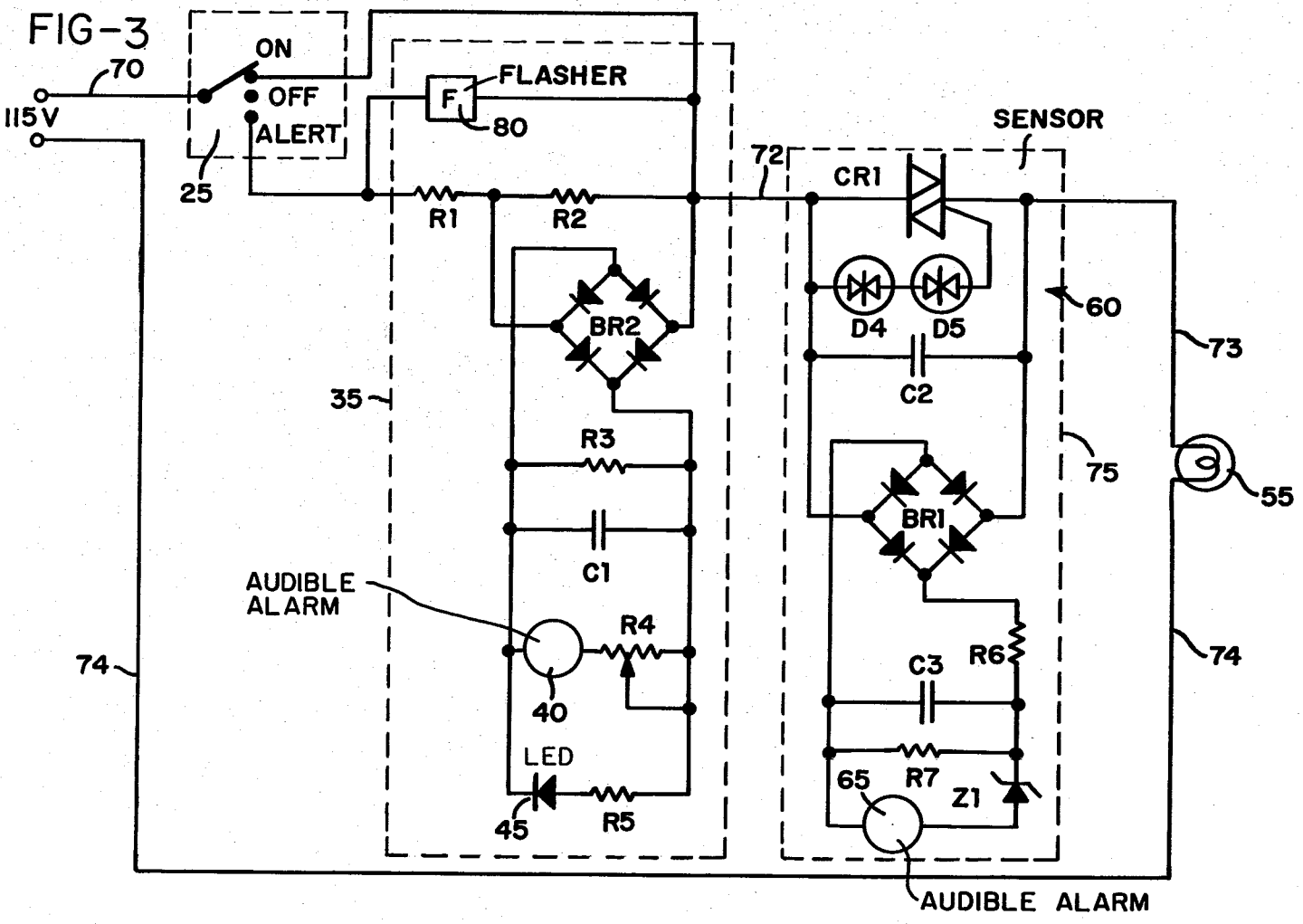
FIG. 3 is an electrical schematic of the preferred embodiment of the invention.

Referring now to FIG. 3, the switch 25, when placed in the up or "on" position, connects line 70 from the house power source directly to the sensor assembly 60 via line 72, and through the sensor assembly to the lamp 55 on line 73; and the other side of the lamp 55 is connected via the return line 74 to the power source. With the switch in the "on" position, as shown in FIG. 3, the lamp 55 will be fully illuminated since the triac CR1 in the sensor circuit 75 will be provided with gating current through the bidirectional trigger diodes D4 and D5. Of course, with the switch in the center or off position, all power to the circuit is removed, and no current will flow to the lamp 55.

When the switch 25 is placed into the down or "alert" position, line 70 is connected to the flasher 80. This flasher is a commercially available, solid state device, SSAC Co. Model No. FS 129, and it causes the current therethrough to be interrupted at a rate of approximately one to two cycles per second.

During the time the flasher 80 is passing current therethrough, the lamp 55 will be illuminated since sufficient voltage will exist on the bilateral trigger diode D4 and D5 to provide gating current for the triac CR1.

During the time that the flasher 80 opens the circuit between the switch 25 and line 72, a current path will be established through resistors R1 and R2 to line 72. Because of the voltage drop developed across these resistors, the bilateral diodes D4 and D5 will not have sufficient voltage thereacross to conduct, and therefore the triac CR1 will not be gated on; however, current will flow from line 72 through bridge rectifier BR1 and through the alarm circuit, including resistor R6, Zener diode Z1 and the alarm 65, to line 73 and through the lamp 55. The voltage output of the bridge BR1 is sufficient to cause the audible alarm 65 to sound. When the flasher 80 is open, the lamp 55 will be extinguished since insufficient current will be provided thereto due to the limiting action of resistors R1, R2 and the circuit 75. On the other hand, the alarm 65 will be activated and will sound. Thus the alarm and lamp will be alternately activated.

During the time that the flasher 80 is conducting, a small voltage will be developed across the triac CR1, and this voltage will be rectified by the bridge rectifier BR1; however, this voltage will be insufficient to overcome the breakdown voltage established by Zener diode Z1, and therefore the alarm A2 will be silent during this period.

Within the dwelling itself, it is preferable to have some form of indication that the alarm circuit has been activated. In the preferred embodiment of the invention, this indication may be both an audible alarm and a visual indicator. Referring again to FIG. 3, bridge rectifier BR2 is connected across resistor R2, and its direct current output is applied to the audible alarm 40. Potentiometer or rheostat R4 may be used to adjust the loudness of the alarm. Also, connected across the bridge is a light emitting diode or LED 45. Resistor R5 is placed in series with LED 45 to limit the current flow therethrough.

As shown in FIGS. 1 and 2, the light emitting diode 45 may be placed in the switch itself, and will be clearly visible when the switch is placed in position 29 or the "alert" position. Obviously, the light emitting diode could be placed in the plate surrounding the switch and accomplish the same purpose.

The values for the components employed in the present invention are included in the following table of parts.

TABLE I

| | | |
|---|---|---|
| RESISTORS | | |
| R1 | 1500 ohm | 3 watt |
| R2 | 1000 ohm | ½ watt |
| R3 | 2200 ohm | ½ watt |
| R4 | Variable Trimpot 3K ohm | ¼ watt |
| R5 | 470 ohm | ½ watt |
| R6 | 470 ohm | 1 watt |
| R7 | 1800 ohm | 1 watt |
| CAPACITORS | | |
| C1 | 47 mfd | 35 volt |
| C2 | 0.1 mfd | 200 volt |
| C3 | 50 mfd | 35 volt |
| OTHER COMPONENTS | | |
| BR1 | Bridge Rectifier, 1 amp., 100 PIV | |
| BR2 | Bridge Rectifier, 1 amp., 50 PIV (Radio | |

TABLE I-continued

| | |
|---|---|
| | Shack RS 276-1161) |
| Z1 | Zener Diode, 11.0 volt, 1 amp. |
| CR1 | Triac, 6 amp, 200 volt (Radio Shack RS 276-1001) |
| D4,D5 | Diodes, bilateral trigger, HEP-R2002 |
| 25 | Switch, 2-position, center off toggle, Hubbell #1381 |
| 40 | Audio Indicator, Projects Unlimited #A1-250 |
| 45 | LED, red, 2 volt, 20 ma/F (Radio Shack RS 276-04 |
| 65 | Audio Indicator, Projects Unlimited A1-250 |
| 80 | Flasher, solid state, SSAC Co. FS129 |

Figure 4:
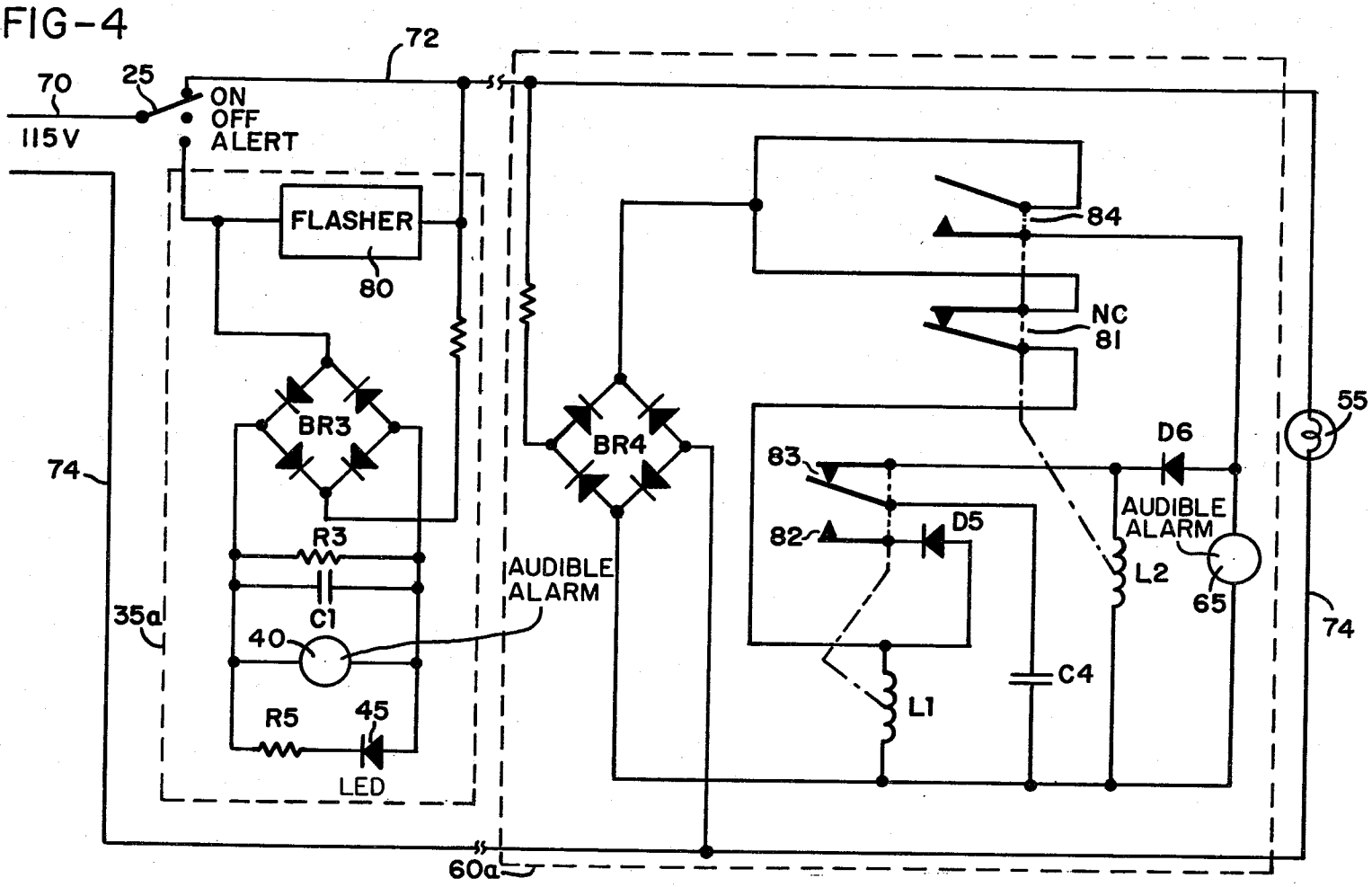
FIG. 4 is an electrical schematic showing an alternative embodiment for the adapter assembly.

Referring now to FIG. 4 which shows an alternative embodiment of the invention, the 115 volt power source is connected to the switch 25 through line 70, and when this switch is in the up or "normally on" position, power is then supplied via lines 72 and 74 directly to the lamp 55. When a switch is placed in the center or "off" position, no current flows to the lamp.

When the switch 25 is placed in the down or "alert" position, line 70 is then connected through the flasher 80 to line 72, causing the lamp 55 to flash at the rate established by the flasher.

Connected in parallel with the flasher 80 is the alarm circuitry including bridge rectifier BR3 which supplies a direct current voltage for the audible alarm 40 and the light emitting diode 45. Thus, each time the flasher is conducting current, current flows to the lamp 55 and it lights, and the voltage is removed from the rectifier BR3 and thus the alarm 40 is silent. When the flasher is open, however, there is a voltage drop across the flasher, and the alarm 40 will sound and the indicator light 45 will be illuminated. The current drawn by the alarm circuit is insufficient to cause the lamp 55 to light or to affect the remainder of the externally mounted circuitry.

Whenever current is applied to the lamp 55, bridge BR4 in the adapter circuit 60A will provide a direct current voltage through the normally closed contacts 81 of relay L2 to the solenoid of relay L1 which will energize, closing contacts 82, and allowing the capacitor C4 to charge to that voltage through diode D5.

When power is removed from line 72, either by placing switch 25 in the "off" position, or through the motion of flasher 80, relay L1 will deenergize immediately, contacts 82 will open, and contacts 83 will close and the energy stored in capacitor C4 will be dissipated through the windings of relay L2, and this relay will then energize, closing contacts 84 and opening contacts 81. Relay L2 will deenergize as soon as the energy from capacitor C4 decreases to the point where the relay armature can no longer overcome the spring bias thereon.

Assume, however, that power is resupplied to line 72 prior to the deenergization of relay L2. In this case, current will then flow from the bridge rectifier through the new closed contacts 84 and through diode D6 to keep relay L2 energized. At the same time, current will flow through diode D6 and contacts 83 to charge capacitor C4. Simultaneously, current will flow through the alarm 65 which will sound for as long as current is applied thereto.

If current is then again interrupted, through the operation of the flasher 80, then relay L2 will remain energized by the energy stored and replenished in capacitor C4, but diode D6 will prevent the energy stored in that capacitor from being dissipated through the alarm 65. Diode D5 prevents the energy in capacitor C4 from being dissipated through relay L1. Thus, as long as the flasher 80 continues to interrupt the circuit at a rate which permits capacitor C4 to maintain relay L2 energized, the alarm 64 will sound each time current is reapplied to the circuit.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An emergency signaling system using an existing two-wire circuit between a switch located within a dwelling and an externally mounted lamp, said switch having an "off" position, a normally "on" position, and an "alert" position, first circuit means associated with said switch and connectable in series with said two-wire circuit, said first circuit means being responsive to said "alert" position of said switch for interrupting the current to said externally mounted lamp at a periodic rate, and said lamp being connected to said two-wire circuit and having associated therewith an audible alarm, and second circuit means, responsive to the interruption of the current in said two-wire circuit, for activating said alarm;

whereby said lamp will flash and said alarm will be sounded at said periodic rate when said switch is placed in the "alert" position, and whereby said lamp will light continuously and said alarm will be silent when said switch is placed in the "normally on" position.

2. The emergency signaling system of claim 1 wherein said first circuit means is physically associated with said switch.

3. The emergency signaling system of claim 1 wherein said first circuit means and said switch are both contained within a protective enclosure within said dwelling.

4. The emergency signaling system of claim 1 further including a second audible alarm is connected to said first circuit means to provide an audible indication within said dwelling when said switch is placed in said "alert" position.

5. The emergency signaling system of claim 1 wherein said second circuit means includes means connected to said two wire circuit for providing a source of direct current, first and second relays each having a set of normally open and normally closed contacts, a capacitor, said first relay having its solenoid connected through a set of normally closed contacts of said second relay to said direct current source, said first relay having normally open contacts connected between said capacitor and said direct current source through normally closed contacts of said second relay whereby, when said first relay is energized and said second relay is deenergized, said capacitor will be connected to said direct current source, said first relay having normally closed contacts connected between said capacitor and the solenoid of said second relay, said capacitor being selected so that it will provide sufficient energy to hold said second relay energized during the period current on said two-wire circuit is interrupted when said switch is placed in said "alert" position, said second relay having normally open contacts interconnecting said alarm with said direct current source whereby said alarm will be sounded when said second relay is energized and the current on said two-wire circuit is not interrupted, and means for connecting said capacitor to said power source through said normally open contacts of said second relay and said normally closed contacts of said first relay.

6. The emergency signaling system of claim 1 wherein said first circuit means includes means for alternately providing full and reduced current to said second circuit means, and wherein said second circuit means includes:

a triac connected in series with said lamp, a bilateral trigger diode connected to the gate electrode of said triac and having a threshold set to gate said triac into conduction when full current is applied thereto, and means connected across said triac for providing current to said audible alarm when reduced current is applied thereto.

7. An emergency signaling system for use in an existing two wire circuit between a switch housing located within a dwelling and an externally mounted lamp a switch having an "off" position, a "normally-on" position, and an "alert" position, first circuit means connectable in series with the two wire circuit, said circuit means being responsive to said "alert" position of said switch for alternately providing at a periodic rate an output at full current level and an output at reduced current level to an adapter means, said adapter means connected in series with said lamp and said two wire circuit, said adapter means including an audible alarm and circuit means responsive to said reduced current level for energizing said alarm, whereby said lamp will flash and said alarm will be sounded at said periodic rate when said switch is placed in said "alert" position, and whereby said lamp will light continuously and said alarm will be silent when said switch is placed in the said "normally-on" position.

8. The emergency signaling means of claim 7 wherein said first circuit means includes an audible alarm and a visual indicator which are energized when said first circuit means provides said reduced current output level.

9. The emergency signaling system of claim 8 wherein said visual indicator is mounted in said switch and wherein said indicator is visible when said switch is placed in the "alert" position.

10. An emergency signaling system including a source of alternating current, an externally mounted lamp, adapter means connected in series with said lamp, an interiorly mounted switch having an "off" position, a "normally-on" position, and an "alert" position, a pair of wires interconnecting said switch and said lamp with said source of alternating current, circuit means connected between said switch and said adapter means and responsive to said switch being placed in said "alert" position for alternately providing full current and reduced current to said adapter means, said adapter means including an audible alarm, a triac connected in series with said lamp, a bilateral trigger diode connected to the gate electrode of said triac and having a threshold level set to gate said triac into conduction when full current is applied thereto, and means connected across said triac for providing current to said audible alarm when said reduced current is applied to said triac, whereby said lamp will flash and said alarm will be sounded when said switch is placed in said "alert" position and whereby the lamp will be illuminated continuously and said alarm will be silent when said switch is placed in the "normally-on" position.

* * * * *